US012195268B1

(12) United States Patent
Benbasat et al.

(10) Patent No.: US 12,195,268 B1
(45) Date of Patent: Jan. 14, 2025

(54) FOOD COOLER WARMER

(71) Applicants: Josh Benbasat, Ft Lauderdale, FL (US); Steve Benbasat, Ft Lauderdale, FL (US)

(72) Inventors: Josh Benbasat, Ft Lauderdale, FL (US); Steve Benbasat, Ft Lauderdale, FL (US)

( * ) Notice: Subject to any disclaimer, the term of this patent is extended or adjusted under 35 U.S.C. 154(b) by 0 days.

(21) Appl. No.: 18/797,428

(22) Filed: Aug. 7, 2024

(51) Int. Cl.
*B65D 81/38* (2006.01)
*A47G 23/02* (2006.01)
*F25D 31/00* (2006.01)

(52) U.S. Cl.
CPC ..... *B65D 81/3886* (2013.01); *A47G 23/0241* (2013.01); *A47G 23/0266* (2013.01); *A47G 2023/0275* (2013.01); *F25D 31/002* (2013.01)

(58) Field of Classification Search
CPC ..... B65D 81/3811; B65D 81/3886; B65D 81/3876; B65D 25/14; A47G 23/0241; A47G 23/02; A47G 23/0266; A47G 2023/0275; F25D 31/002; A45C 11/20; Y10S 220/9151
USPC ..... 220/739, 737, 915.2, 915.1, 592.26, 220/592.21, 592.2, 62.22, 62.12, 62.11; 62/457.7
See application file for complete search history.

(56) References Cited

U.S. PATENT DOCUMENTS 1,949,677 A * 3/1934 Crawford ..... B65D 81/3886 383/110
3,779,298 A * 12/1973 Piccirilli ..... B44C 1/18 220/62.12
4,282,279 A * 8/1981 Strickland ..... B65D 25/34 206/139
4,372,453 A * 2/1983 Branscum ..... B65D 81/3876 220/592.25
4,399,919 A * 8/1983 Posnansky ..... A47J 41/005 220/592.27
5,109,588 A * 5/1992 Hewlett ..... B65D 81/3883 29/428
5,261,554 A * 11/1993 Forbes ..... B65D 81/3886 220/625
2001/0006083 A1* 7/2001 Haberkorn ..... B60P 3/20 220/592.24
2006/0138154 A1* 6/2006 Essel ..... B65D 81/3886 220/737
2009/0101659 A1* 4/2009 Morlan ..... A47G 23/032 220/592.16

* cited by examiner

*Primary Examiner* — Robert J Hicks
(74) *Attorney, Agent, or Firm* — Christopher J. Vandam, PA; Chris Van Dam

(57) ABSTRACT

A can, bottle or other food product is placed inside a laminated cooler and/or warmer constructed of an inner liner surrounded by a thermal retentive slab surrounded by an optional insulation layer surrounded by a protective shell. Optionally an opening with integrated closure is provided to allow easier insertion of the food product into the interior. The gap space between the liner and food product is preferably minimized to allow thermal flow to or from slab to the food.

8 Claims, 4 Drawing Sheets

FOOD COOLER WARMER

CROSS-REFERENCES TO RELATED APPLICATIONS

None.

STATEMENT REGARDING FEDERAL SPONSORED RESEARCH OR DEVELOPMENT

None.

NAMES OF PARTIES TO A JOINT RESEARCH AGREEMENT

None.

REFERENCE TO A "SEQUENCE LISTING", A TABLE, OR A COMPUTER PROGRAM LISTING APPENDIX SUBMITTED ON COMPACT DISC AND INCORPORATION-BY-REFERENCE OF THE MATERIAL ON THE COMPACT DISCLOSURE

None.

STATEMENT REGARDING PRIOR DISCLOSURES BY AN INVENTOR OR JOINT INVENTOR

None.

BACKGROUND OF THE INVENTION

1. Field of the Invention

The present invention relates to food-service, and more particularly, to an improved device and method of use to maintain and control the temperature of food or drinks.

2. Description of Related Art Including Information Disclosed Under 37 CFR 1.97 and 37 CFR 1.98

The prior art has failed to solve the issues of being able to use the same device to increase, decrease and/or maintain the temperature of foods and drinks. Further, existing devices are inefficient at either heating or cooling do to incomplete contact with the food product and airspace inherent in the design. The prior art also fails to provide a high-capacity thermal regulator with insulation in a flexible format that reduces the bulkiness of the device, yet maintains high-efficiency.

Several designs for can coolers and food coolers have been designed in the past. The prior art generally falls into categories including insulators or structures incorporating frozen packets. The insulated devices, such as can sleeves or styrofoam containers, are limited to reducing the depletion of heat or cold energy. They cannot even maintain the initial temperature of the food product. Alternatively, frozen packets are generally linked containers of gel that is frozen. The material containing the gel must include flexible joints and therefore introduces airspace and requires a greater bulk and volume of material to affect the temperature of the food product. These also are both generally used only to cool and are unable to heat a beverage.

Other patents describing the closest subject matter provide for a number of more or less complicated features that fail to solve the problem in an efficient and economical way. None of these patents suggest the novel features of the present invention.

A brief abstract of the technical disclosure in the specification and title are provided as well for the purposes of complying with 37 CFR 1.72 and are not intended to be used for interpreting or limiting the scope of the claims.

Without limiting the scope of the invention, a brief summary of some of the claimed embodiments of the invention is set forth below. Additional details of the summarized embodiments of the invention and/or additional embodiments of the invention may be found in the detailed description of the invention below.

BRIEF SUMMARY OF THE INVENTION

It is one of the main objects of the present invention to provide a device with a thermal retention layer slab that maximizes contact with the food product contained therein.

It is another object of this invention to provide a device utilizing the thermal retention slab for either increasing or maintaining selectively heating or cooling the food product.

It is still another object of the present invention to provide a reusable and compact device to heat or cool foods and drinks.

It is yet another object of the present invention to provide an environmentally responsible and easy to use device for maintaining preferred temperatures of foods.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE SEVERAL VIEWS OF THE DRAWINGS

With the above and other related objects in view, the invention exists in the details of construction and combination of parts as will be more fully understood from the following description, when read in conjunction with the accompanying drawings in which.

DETAILED DESCRIPTION OF THE INVENTION

Figure 1:
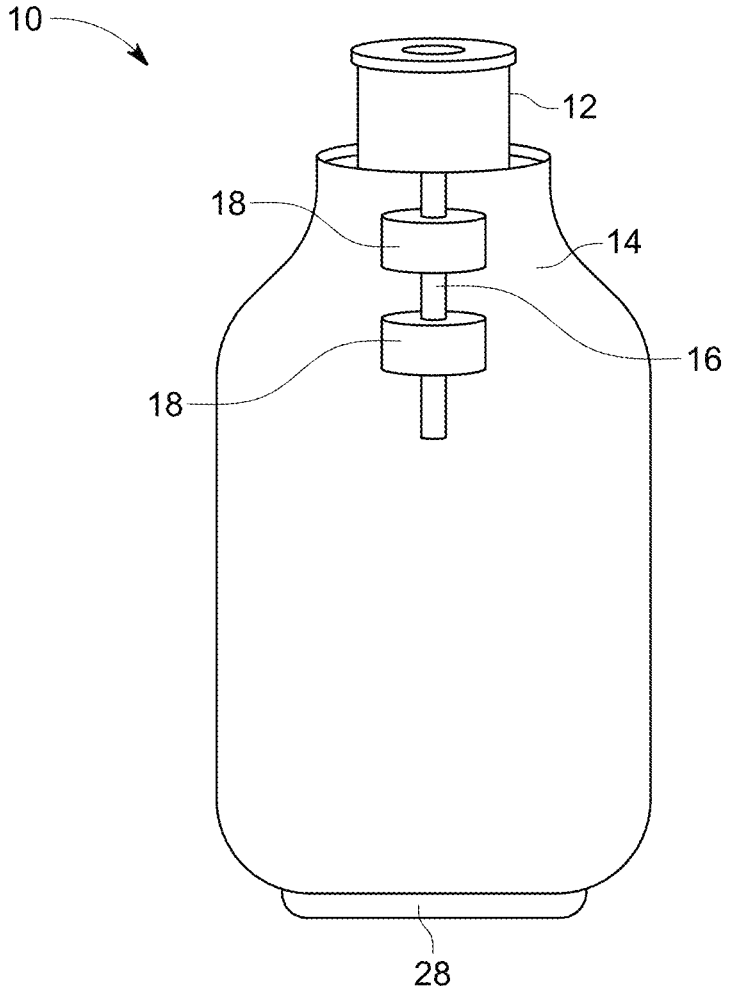
FIG. 1 shows a perspective view of a beverage bottle contained by a food cooler and/or warmer.

While this invention may be embodied in many different forms, there are described in detail herein specific embodiments of the invention. This description is exemplary of the principles of the invention and is not intended to limit the invention to the particular embodiments illustrated and described.

For the purpose of this disclosure, like reference numerals in the figures shall refer to like features unless otherwise indicated or is obvious by context.

The subject device and method of use is sometimes referred to as the device, the invention, the food cooler, the food warmer, the can cooler, the beverage container, the machine or other similar terms. These terms may be used interchangeably as context requires and from use the intent becomes apparent. The masculine can sometimes refer to the feminine and neuter and vice versa. The plural may include the singular and singular the plural as appropriate from a fair and reasonable interpretation in the situation.

Referring now to the drawings, where the present invention is generally referred to with numeral 10, it can be observed that it basically includes a bottle 12, a shell 14, an opening 16, a closure 18, insulation 20, a slab 22, a liner 24, an interface 26, a base 28, a can 30, an interface 32, a shell 34, a packet 36, a joint 38, an interface 40, a can 42, a hinge 44, a latch 46, a shell 48, insulation 50, a slab 52, a liner 54, a food 56 and an interior 58.

Figure 3:
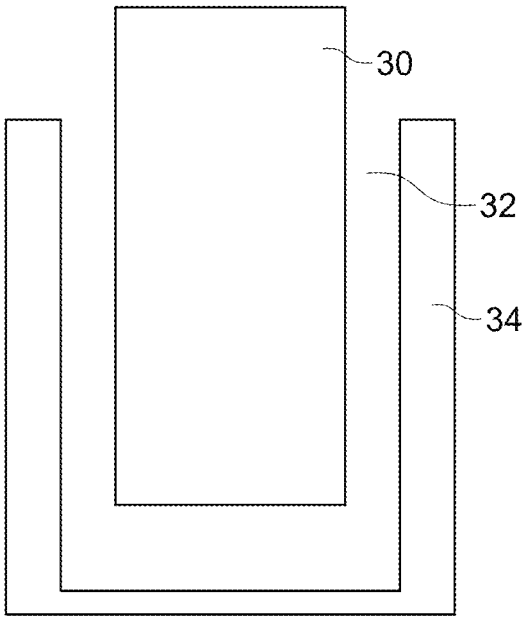
FIG. 3 shows examples of prior art attempts to insulate or cool food products.
Figure 3:
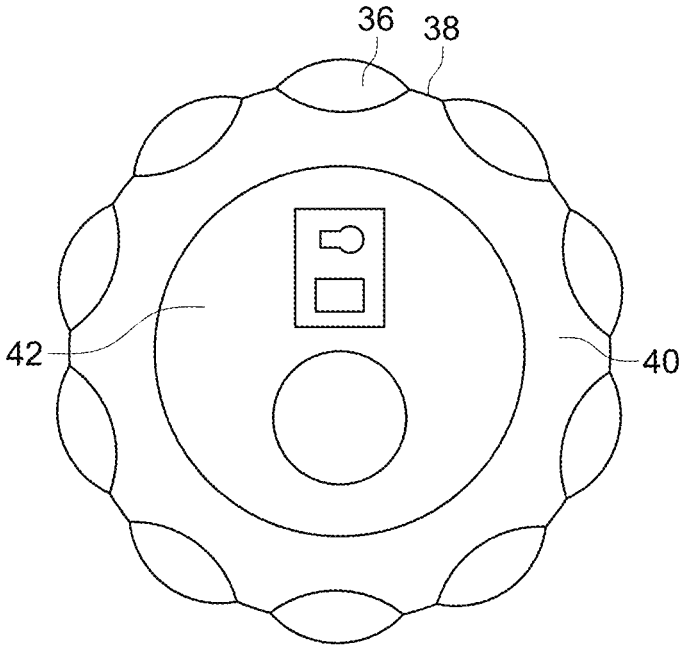

FIG. 3 shows two examples of prior art attempts at controlling the temperature of beverages. The upper example shows an elevation cross section of a typical styrofoam or neoprene shell 34 into which a can 30 is inserted. The shell 34 is an attempt at insulating the can 30. The shell 34 cannot reduce the temperature or even maintain the temperature of the can 30. At best, the shell 34 slows the warming of the contents of the can 30. The can 30 will never be colder than the moment it was inserted into the shell 34.

Some designs of the shell 34, shown in FIG. 3, include an airspace interface 32. This gap interface 32 may allow different size cans 30 to be inserted. It may also result in an air gap between the shell 34 and can 30 to reduce conductive heat transfer from the shell 34 into the can 30. Either way, if the can 30 is tight against the shell 34 then the heat transfer is increased or if a gap interface 32 is provided the effectiveness of any insulated qualities of the shell 34 is reduced.

The lower example of prior art shown in FIG. 3 is a top plan view showing the can 42 surrounded by a series of packets 36. Each of the packets 36 is connected by a joint 38 to allow some flexibility because the packets 36 are often rigid and frozen. Often an interface 40 is provided as a gap between the can 42 and packet 36. This interface 40 is included in the design to allow different size cans 42 or bottles to fit inside. Because the packets 36 do not completely encircle the can 42 because of the joint 38, a greater volume of packet 36 is required. This increases the weight and bulkiness of the design.

Figure 2:
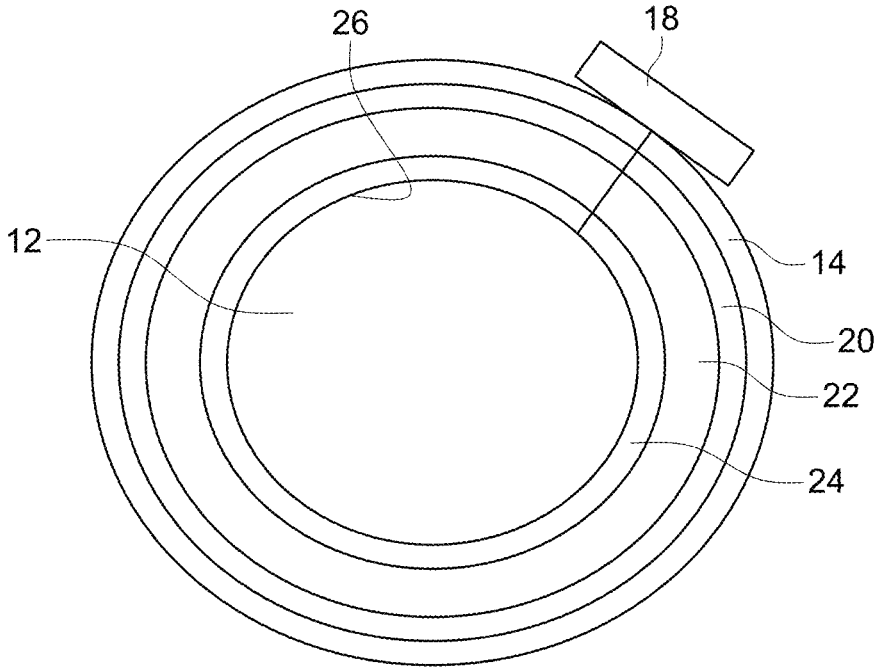
FIG. 2 shows a top plan cross-section of the food cooler and warmer shown in FIG. 1.

An example of the present food cooler heater is shown in FIGS. 1 and 2. An important component is the slab 22. The slab 22 is elastic, flexible, structural and soft. Slab 22 can be heated before the container, such as a bottle 12, is inserted. It can be heated, for example, with hot water, an oven or a microwave. When the bottle 12 is placed in the device, the heat from the slab 22 may then transfer to the bottle 12 to not only maintain the temperature but increase it.

Similarly, the slab 22 may be chilled by placing in a refrigerator, freezer or ice bath. This can bring the temperature of the slab 22 below that of the bottle 12. The slab 22 then, will not only maintain the coolness of the bottle 12, but may reduce its temperature as well. In this way, the bottle 12 may maintain or reduce its temperature for a protracted period of time, potentially hours.

Figure 4:
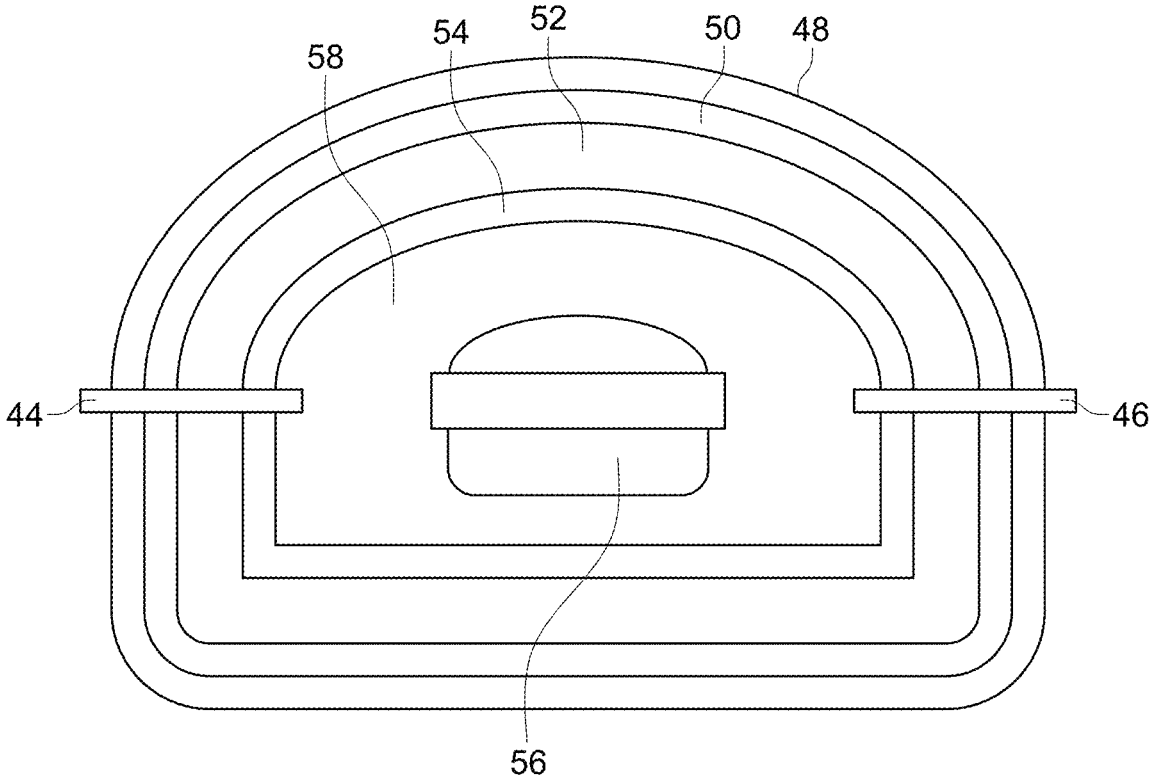
FIG. 4 shows an alternate version of the food cooler and/or warmer suited for solid food products.

The shape of the food cooler and warmer may be adapted to a specific size can, bottle or food containers. For example, the bottle shape may be smaller for a standard bottle of beer or larger for a bottle of wine. For specific food containers, as demonstrated in FIG. 4, the dimensions of the food cooler and warmer may be adapted to a single meal or a multi-serving platter, a pizza or other food dish.

For some shapes, an opening 16 with closures 18 may be advantageous to snugly fit the bottle 12 inside the device with a minimal air gap in the interface 26. Once the bottle 12 is inserted through the opening 16, the closures 18 are refastened. The closures 18 may be snaps, laces, hook and loop fasteners, magnets, buttons, clips or other commonly available fastening means to reclose the opening 16.

In a closely related version of the device shown in FIG. 1, the opening 16 and closures 18 are absent. This is possible if the food cooler warmer is not adapted to cover the neck of the bottle 12. This may be well suited for a cylindrical can. Further, the opening 16 may not be necessary for cans having a consistent diameter. The stretchiness of the composite layers, as shown in FIG. 2, also may allow the device to flex when fitting over the bottle or can.

The base 28 is optionally provided at a surface-contacting bottom of the device. It may be made from a durable and resilient, flat material to provide structure to keep the bottle 12 up right. The base 28 may be made of the thermal slab 22 material or of a rigid and/or insulative plastic or similarly performing material. The base 28 may also be constructed of the series of layers as shown in FIG. 2, similar to the sidewall of the food cooler and warmer.

Looking now at FIG. 2, a plan view cross-section of the several layers of the device are demonstrated. The innermost layer is an optional liner 24. The liner 24 contacts the bottle 12 at the interface 26 surface. The liner 24, if present, is adhered to the inner surface of the slab 22. Encircling the slab 22 is an optional insulation 20 layer. The most external layer is the shell 14.

Generally each the liner 24, slab 22, insulation 20 and shell 14 generally spanned from the lower surface of the bottle 12 covering the majority of the exterior surface of the can or bottle 12. Preferably, the exterior surface of the bottle 12 is in direct contact with the liner 24, if present, or directly to the slab 22 if no liner 24 is used. The interface 26 is therefore not an air gap but a direct contact with the bottle 12.

Each of the layers: liner 24, slab 22, insulation 20 and shell 14 are elastic, flexible, stretchable and soft. The bottle 12 may be friction fit against the liner 24 or slab 22 (if no liner 24 is used). This ensures an efficient thermal transfer from the heated or cooled slab 22 into the bottle 12. It should be appreciated that the term bottle 12 is inclusive of any liquid vessel, specifically including, but not limited to, a variety of shapes of bottles, jars and cans.

The presence of the slab 22 is an important component of the food cooler and heater. The slab may be made in various thicknesses depending on the thermal retention needs of the intended food to be heeded or cooled. For example, the slab may be as thin as about 1 mm or as thick as about 30 mm. Generally, the slab 22 is a uniform thickness throughout. The slab 22 may be comprised of multiple similar layers positioned together to increase the thermal retention properties or to vary the thickness of the slab 22.

The term thermal retention is intended to include the ability of the slab 22 to retain a temperature cooler than the environment and/or warmer than the environment and to have the ability to transfer that coolness or heat into the food contained in the device.

Various chemistries of the slab have been found to be effective. The slab 22 should be flexible, pliable and stretchable to expand slightly to fit snugly around the food being heated or cooled. In some versions of the device the slab 22 is dimensioned slightly larger than the object placed inside the device to allow those food products to easily fit within the device and not require stretching of the other laminate layers, such as the liner 24 or shell 14.

In one effective version of the chemistry of slab 22, the slab is comprised by weight of approximately two thirds water, a quarter glycerol and one to five percentage each of cellulose, sodium salt and carboxymethyl ether. These ingredients are combined to produce a solid slab that can be cut into the necessary shapes to form the geometry necessary to contain the food product.

Another configuration of the slab 22 found to be effective is a hydrogel encapsulated in a polymer seal or skin. A variety of commercially available hydrogel compositions are available. For example, a hydrogel comprising about half water and a hygroscopic compound such as acrylamide alginate copolymer. Optionally, the hydrogel may include a salt such as calcium chloride, magnesium chloride, copper chloride, zinc chloride, calcium oxide, magnesium oxide, barium oxide, magnesium sulfate, sodium sulfate, calcium sulfate, copper sulfate, potassium carbonate and or sodium carbonate. If present, these salts may be between approximately 10 and 40% by weight of the overall formula.

The polymer seal encapsulating the hydrogel provides the flexible and pliable shape configuration to encircle the food product being heated or cooled. The polymer seal also allows for laminate adhesion of other layers, such as the insulation layer 20 and shell 14. The liner 24 may be embodied in the polymer encapsulation surrounding the slab 22.

The shell 14 layer is an exterior coating of the device to provide protection to the inner layers and abrasion resistance. The shell layer 14 may also provide a degree of insulation. The shell 14 may be comprised of a fabric or polymer layer that is adhered to an exterior surface of the insulation layer 20 or the slab 22 itself if no independent insulative layer is present. The shell 14 may be a skin of the insulation layer 20, such as skinned over neoprene. The exterior surface of the shell 14 may include decorative elements, printing or branding.

The insulation 20 layer is external to, and surrounding the slab 22. The insulation 20 layer tends to direct any heat or cooling toward the interior of the device. The insulation 20 layer may be bonded to the slab 22 on an interior surface and the shell 14 on an exterior surface. The insulation 20 may be fabricated from a wide variety of flexible and insulated materials, such as polymers, polymer foams, neoprene, composites, aero gel, nonwoven fiberglass or other material that provides an insulation quotient around the slab 22.

The liner 24 layer, if present, provides a protective barrier between the bottle 12 and slab 22. The liner 24 may be formed of the encapsulating polymer around the slab 22, as noted above. The liner 24 is generally a flexible and provides a resilient and protective layer between the bottle 12 of the slab 22. The interior surface of the liner 24 may also provide a resilient surface along which the bottle 12 may slide against while inserting into the device. Suitable materials for the liner 24 may be polymer sheeting, mylar, thermoplastic elastomer (eg. TPU, polyurethane) or other membrane.

Some chemistries of the slab 22 material may be better suited to a cooling device than to a warming device. Others, will be suitable for both holding a high temperature for warming and a low temperature for cooling. Yet others will be better suited for a warming only device. Similarly, some types of liner 24 and shell 14 may be better suited to only heating or only cooling, while others will perform well with both high and low temperatures. The other layers and how they form a laminate bond together may also tend to be better suited to heating or cooling or both. Liner 24 and shell 14 may have inherent insulative characteristics and/or may include an additional insulation layer on either an interior or exterior surface of the respective layer. In at least one iteration of the device the insulative layer is bonded to the slab 22.

For integrity of the device, the shell 14, liner 24, slab 22 and insulation 20, if present, should remain flexible and able to maintain a laminate bond between the layers at the anticipated temperatures of the food being held inside the device. Preferably, the materials of these components should be economical, environmentally responsible and easy to clean.

An important version of the invention can be fairly described as a beverage cooler or more having a shell layer, an optional insulation layer, a slab layer and a liner layer, all laminated together. The liner is dimensioned to wrap around a predetermined size can or bottle without a substantial gap between the liner and the can or bottle. The liner and shell are flexible and remain so when adhered to the slab. Essentially, the liner snugly holds the bottle with minimum airspace between the bottle and the liner. The slab is the thermal retentive layer that is similarly dimensioned to the liner and is adhered to in wraps around the liner. The heat or cool in the slab passes through the liner into the can or bottle. An optional insulation layer is similarly dimensioned to and wraps around the slab. The shell provides an outer protective layer around the beverage cooler warmer. The slab is constructed of a thermally retentive material and has a uniform thickness and is flexible. Generally, the slab remains flexible through the entire range of temperatures that a beverage would be cooled or heated to. Optionally, an opening is provided with a closure that allows the can or bottle to more easily be inserted into the interior of the liner. Optionally, a resilient base layer may be affixed to the bottom surface of the beverage cooler warmer to provide a stable and resilient surface onto which the beverage cooler warmer is placed. Another version of the device is more suited as a food cooler and warmer, as opposed to primarily beverages or soups. Having a similar construction, the food cooler warmer includes a liner dimensioned to completely surround and enclose a predetermined food product, such as a sandwich, casserole, pizza or other portion of food. The food style container could contain a beverage and the beverage style device could equally hold a food product. The slab then wraps around the liner and is adhered to the outer surface of the liner. Next an optional insulated layer surrounds the slab. The shell is adhered to in wraps around the optional insulation layer to provide a durable and resilient exterior surface. The slab is also constructed of a thermally retentive material that has a uniform thickness and is flexible. An opening is provided to allow access to the interior of the food cooler warmer and has a closure, such as a snap, tab-slot combination, hook and loop or other similar closure device. Optionally, the food cooler warmer may also include a resilient based layer under the device.

It should be appreciated that the term food is generally intended to include any food or drink product or packaging therefor. For example, the term can or bottle may include containers for both liquid and solid foods. In another example, the design may be cylindrical and could work equally well for a can of soda, a bottle of beer, a tub of dip or a burrito. Essentially, the inventive nature is in that of the combination of elements and is not dependent on the precise nature of the comestible contained inside the device.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

We claim:

1. A beverage cooler warmer comprised of a shell, a slab and a liner;

the liner is dimensioned complementary to and wraps around a predetermined can or bottle without a gap between the liner and the can or bottle;

the slab wraps around the liner and is adhered to and covers an outer surface of the liner;

the shell wraps around the slab and is adhered to and covers an outer surface of the slab;

the shell and the liner are both flexible;

the slab is constructed of a thermally retentive material and has a uniform thickness and is flexible.

2. The beverage cooler warmer of claim 1 further characterized in that an opening bisects through all layers of a side of the beverage cooler warmer to provide an opening to insert a bottle or can and a closure is positioned to hold the opening closed after the bottle or can is inserted.

3. The beverage cooler warmer of claim 1 further characterized in that a base layer is affixed to a bottom surface of the beverage cooler warmer.

4. The beverage cooler warmer of claim 1 further characterized in that the shell is insulative or includes an additional insulating layer against the slab.

5. A food cooler warmer comprised of a shell, a slab and a liner;

the liner is dimensioned to completely enclose a predetermined food product;

the slab wraps around the liner and is adhered to and covers an outer surface of the liner;

the shell wraps around the slab and is adhered to and covers an outer surface of the slab;

the slab is constructed of a thermally retentive material and has a uniform thickness and is flexible;

an opening is provided bisecting the liner, slab and shell sufficient to insert and remove the food product.

6. The food cooler warmer of claim 5 further characterized in that a base layer is affixed to a bottom surface of the food cooler warmer.

7. The food cooler warmer of claim 5 further characterized in that the shell is insulative or includes an additional insulating layer against the slab.

8. The food cooler warmer of claim 5 further characterized in that the opening has a closure to operably seal the opening.

* * * * *